US012121064B2

(12) United States Patent
Zhou et al.

(10) Patent No.: US 12,121,064 B2
(45) Date of Patent: Oct. 22, 2024

(54) ELECTRONIC ATOMIZATION DEVICE AND ATOMIZATION ASSEMBLY THEREOF, AND MANUFACTURING METHOD OF ATOMIZATION ASSEMBLY

(71) Applicant: SHENZHEN SMOORE TECHNOLOGY LIMITED, Shenzhen (CN)

(72) Inventors: Hongming Zhou, Guangdong (CN); Caiqiang Zhu, Shenzhen (CN); Chunfeng Zhang, Shenzhen (CN); Chaoyong Bie, Shenzhen (CN); Jianxin Xiao, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 457 days.

(21) Appl. No.: 17/527,193

(22) Filed: Nov. 16, 2021

(65) Prior Publication Data

US 2022/0071290 A1 Mar. 10, 2022

Related U.S. Application Data

(63) Continuation of application No. PCT/CN2019/127194, filed on Dec. 20, 2019.

(30) Foreign Application Priority Data

May 16, 2019 (CN) ..... 201910411426.9

(51) Int. Cl.

| | |
|---|---|
| ***A24F 40/46*** | (2020.01) |
| ***A24F 40/10*** | (2020.01) |
| ***A24F 40/70*** | (2020.01) |

(52) U.S. Cl.
CPC ..... *A24F 40/46* (2020.01); *A24F 40/10* (2020.01); *A24F 40/70* (2020.01)

(58) Field of Classification Search
CPC ..... A24F 40/46; A24F 40/40; A24F 40/70; A24F 40/10
(Continued)

(56) References Cited

U.S. PATENT DOCUMENTS 5,665,262 A * 9/1997 Hajaligol ..... A24F 40/46 131/194
9,065,216 B2 * 6/2015 Chang ..... H01R 13/6585
(Continued)

FOREIGN PATENT DOCUMENTS

CN 105813815 A 7/2016
CN 105917734 A 8/2016
(Continued)

OTHER PUBLICATIONS

The extended European search report of EP application No. 19928734.3 issued on Jun. 17, 2022.
(Continued)

*Primary Examiner* — Harshad C Patel
(74) *Attorney, Agent, or Firm* — Andrew C. Cheng

(57) ABSTRACT

Provided are an electronic atomization device and an atomization assembly thereof, and a manufacturing method of the atomization assembly. The atomization assembly includes a porous matrix and a heating body. The porous matrix includes an atomization face. The heating body includes a heating part and at least one fixing part connected to the heating part. The at least one fixing part is embedded in the porous matrix, such that the heating body is mounted on the porous ceramic matrix and the heating part is arranged to correspond to the atomization face. The beneficial effect is that mounting of the heating body is realized by having the
(Continued)

fixing part embedded in the porous matrix to improve reliability of the atomization assembly.

16 Claims, 5 Drawing Sheets

(58) Field of Classification Search
USPC ..... 131/329
See application file for complete search history.

(56) References Cited

U.S. PATENT DOCUMENTS

| | | | | |
|---|---|---|---|---|
| 10,440,998 | B2 * | 10/2019 | Polloni | A24F 40/42 |
| 11,730,199 | B2 * | 8/2023 | Atkins | A24F 40/485 131/329 |
| 11,933,454 | B2 * | 3/2024 | Mironov | F16T 1/00 |
| 2016/0338410 | A1 * | 11/2016 | Batista | H05B 3/34 |
| 2017/0079332 | A1 * | 3/2017 | Li | A24F 40/46 |

FOREIGN PATENT DOCUMENTS

| | | | |
|---|---|---|---|
| CN | 206136341 | U | 4/2017 |
| CN | 108158040 | A | 6/2018 |
| CN | 108185535 | A | 6/2018 |
| CN | 108208938 | A | 6/2018 |
| CN | 109349681 | A | 2/2019 |
| CN | 109608206 | A | 4/2019 |
| CN | 109674094 | A | 4/2019 |
| CN | 110301674 | A | 10/2019 |
| CN | 210158019 | U | 3/2020 |
| CN | 211746932 | U | 10/2020 |
| JP | S63292049 | A | 11/1988 |
| JP | H0551278 | A | 3/1993 |
| JP | H07217885 | A | 8/1995 |
| JP | 2004087476 | A | 3/2004 |
| WO | 2015117701 | A1 | 8/2015 |
| WO | 2017207320 | A1 | 12/2017 |

OTHER PUBLICATIONS

International Written Opinion of PCT Patent Application No. PCT/CN2019/127194 issued on Mar. 27, 2020.
The second office action of CN patent application No. 201911329421.8 issued on Jan. 12, 2024.
Notice of Allowance of CN patent application No. 201911329421.8 issued on Feb. 5, 2024.
The first office action of CN patent application No. 201911329429.4 issued on Jan. 19, 2024.
Search report of CN patent application No. 201911329429.4 issued on Jan. 19, 2024.
Zhengnong Xia, Title: Electrical materials, Title of the book: Great Cictionary, Mechanical & Electrical Volume, pp. 319-321, published by Shanghai Lexicographical Publishing House on Dec. 31, 2007.
Search report of CN application No. 201911329421.8 issued on Sep. 18, 2023.
First OA of CN application No. 201911329421.8 issued on Sep. 18, 2023.
International Search Report of PCT Patent Application No. PCT/CN2019/127194 issued on Mar. 27, 2020.
Notice of handling the registration formalities of CN patent application No. 201911329429.4 issued on Sep. 3, 2024.
Grant of notice of patent right of CN patent application No. 201911329429.4 issued on Sep. 3, 2024.
Search report of CN patent application No. 201911329429.4 issued on Sep. 3, 2024.
The second office action of CN patent application No. 201911329429.4 issued on Jun. 20, 2024.

* cited by examiner

1

ELECTRONIC ATOMIZATION DEVICE AND ATOMIZATION ASSEMBLY THEREOF, AND MANUFACTURING METHOD OF ATOMIZATION ASSEMBLY

FIELD OF THE INVENTION

The present invention relates to a liquid atomization device, and more particularly to an electronic atomization device and an atomization assembly thereof, and a manufacturing method of the atomization assembly.

DESCRIPTION OF THE RELATED ART

Typical electronic atomization devices, such as electronic cigarettes, include an atomization assembly that is made up of a porous ceramic body for conducting liquid and a heating film disposed on the porous ceramic body. In the related art, the ceramic atomization assembly is made by directly printing electronic paste on a ceramic blank, followed by baking at a high temperature and then subjected to processing for electrodes and wirings to form the ceramic atomization assembly. However, printing electronic paste may suffer localized density inhomogeneity of the electronic paste, and this may result in non-uniform resistance in the heating circuit, and eventually leading to non-uniform distribution of temperature in the heating film. This may easily cause breaking of the heating wires and makes the ceramic atomization assembly warping and deforming. Once the extent of warping exceeds the pre-stressing of the ceramic, the ceramic atomization assembly gets cracking, and the service life of the atomization assembly is thus affected. Further, the fabrication cycle is long. The ceramic matrix, after sintering, must be subjected to secondary sintering for the screen-printed heating film. Screen printing operation cycle is long and the management control is severe, and the cost is high. Stability of resistance is influenced by the manufacturing operation and selecting must be applied for appearance defects and cracking. Further, as the heating film is formed by sintering and jointing alloy particles, it is not possible to eliminate internal microscopic defects, and the distribution of the internal microscopic defects is not uniform. This leads to poor temperature uniformity of the heating film during heating, and the distribution of stress is poor, resulting in localized stress concentration, leading to worsening of the cracking and defects, and eventually becoming failure, which may cause the risk of electrical resistance increasing resulting from dry burning due to running out of liquid during vaping. As being affected by the stability of resistance, it is relatively hard to realize extended service life and high power. The heating film is disposed above the ceramic surface and as being constrained by the size of alloy particles and screen printing plat, it is hard to reduce and thin the film width and film thickness. This makes it hard for cigarette liquid to permeate, and as the heating film cannot be efficiently permeated by the cigarette liquid, it is easy to cause dry burning and scorching, this being disadvantageous for extension of service life and operation with high power. The heating film is tightly attached to the ceramic, and as the heating film is more brittle and is inflexible, local stress may get great due to thermal oscillation during vaping, and this may readily cause cracking and peeling of the heating film.

SUMMARY OF THE INVENTION

The technical issue that the present invention is made to overcome is to provide an improved atomization assembly and a manufacturing method thereof.

To resolve the above technical issues, the present invention provides an atomization assembly, wherein the atomization assembly comprises a porous matrix and a heating body, and the porous matrix comprises an atomization face; the beating body comprises a heating part and at least one fixing part connected to the heating part, and the at least one fixing part is embedded in the porous matrix so as to have the heating body mounted on the porous matrix, the heating part being arranged to correspond to the atomization face.

In some embodiments, the heating body is integrally formed on the porous matrix by means of sintering.

In some embodiments, the porous matrix is a porous ceramic matrix.

In some embodiments, the porous ceramic matrix is made of a diatomite ceramic material.

In some embodiments, the at least one fixing part is formed with at least one fixing hole, and at least one embedding groove comprises a fixing pillar penetrating in the at least one fixing hole.

In some embodiments, the at least one fixing part comprises a large-size portion distant from the heating part and a small-size portion adjacent to the heating part.

In some embodiments, the at least one fixing part is of a shape of trapezoid, wherein a short-base portion of the trapezoid of the at least one fixing part is located adjacent to the heating part, and a long-base portion of the trapezoid is located distant from the heating part.

In some embodiments, the at least one fixing part is of a shape of trapezoid, wherein a short-base portion of the trapezoid of the at least one fixing part is located adjacent to the heating part, and a long-base portion of the trapezoid is located distant from the heating part.

In some embodiments, at least one second fixing part is further included and connected to the heating part, the at least one second fixing part being of a T-shape, the heating part being connected to a small end of the T-shape.

In some embodiments, the heating body is made of a FeCrAl alloy material.

In some embodiments, the heating part comprises a heating net.

In some embodiments, the heating net comprises a heating wire, and the heating wire has a cross-section that is of a shape of trapezoid, a long base of the trapezoid being embedded in the atomization face, a short base of the trapezoid being slightly higher than the atomization face or being flush with the atomization face.

In some embodiments, the porous matrix comprises a liquid suction face opposite to the atomization face, the liquid suction face being recessed in a direction toward the atomization face to form a recessed cavity.

In some embodiments, the at least one fixing part comprises a first fixing part and a second fixing part that are spaced from each other, the first fixing part and the second fixing part being respectively connected with two ends of the heating part and extended in a direction toward one side of the heating part.

In some embodiments, the heating body further comprises a first electrode part and a second electrode part connected to two ends of the heating part, and the first electrode part and the second electrode part are in the form of a rectangular plate.

In some embodiments, the heating part comprises a first soldering part and a second soldering part located on two ends thereof; the atomization assembly further comprises two electrode wires, the two electrode wires being respectively and electrically connected with the first soldering part and the second soldering part.

In some embodiments, the heating part is embedded in or laid flat on the atomization face.

An electronic atomization device comprises the above-described atomization assembly.

A manufacturing method for the above-described atomization assembly comprises the following steps:

Step One: providing a porous ceramic paste and the heating body;

Step Two: forming a porous ceramic blank that is combined with the heating body, wherein the porous ceramic blank comprises a surface that corresponds to the atomization face after formation, the fixing parts of the heating body are embedded in the porous ceramic blank, and the heating part corresponds to the surface that corresponds to the atomization face after formation;

Step Three: removing blank that carries the heating body out of the forming cavity to be subjected to high temperature sintering under conditions of vacuum being 0.2-10 Pa and a temperature being 1100° C.-1400° C., such that the blank, after the sintering, forms the porous ceramic matrix, the heating body being integrally formed in the porous ceramic matrix to form the above-described atomization assembly.

In some embodiments, a step is added between Step Two and Step Three: subjecting the porous ceramic blank to glue-removing sintering in an oxygen-containing environment at a temperature of 200° C.-800° C. to obtain a glue-removed porous ceramic blank.

The beneficial effect of the present invention is that mounting of the heating body is realized by having the fixing parts embedded in the porous matrix to improve reliability of the atomization assembly.

DETAILED DESCRIPTION OF PREFERRED EMBODIMENTS OF THE INVENTION

A more detailed illustration and clear and complete description is provided below for a specific structure, a manufacturing method, and efficacy of the present invention, with reference to the instant embodiment and the attached drawings together. Reference is now made to the attached drawings, in which similar reference signs are used to indicate the same structural components of the present invention or features of the drawings.

Figure 1:
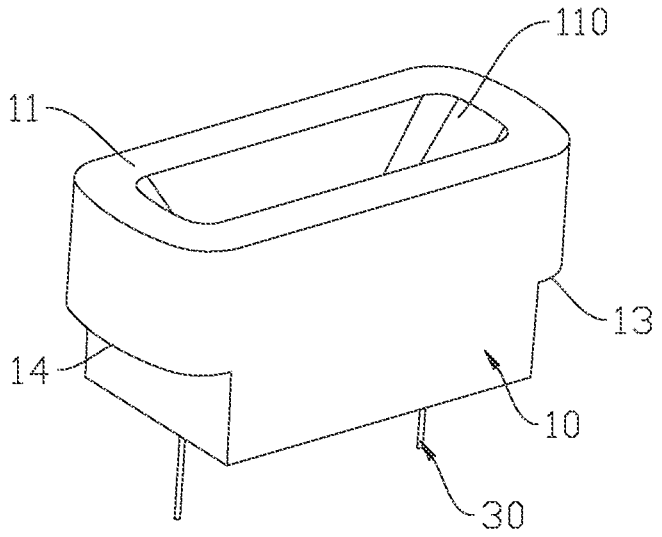
FIG. 1 is a perspective view, in a schematic form, showing a structure of an atomization assembly according to some embodiments of the present invention.
Figure 2:
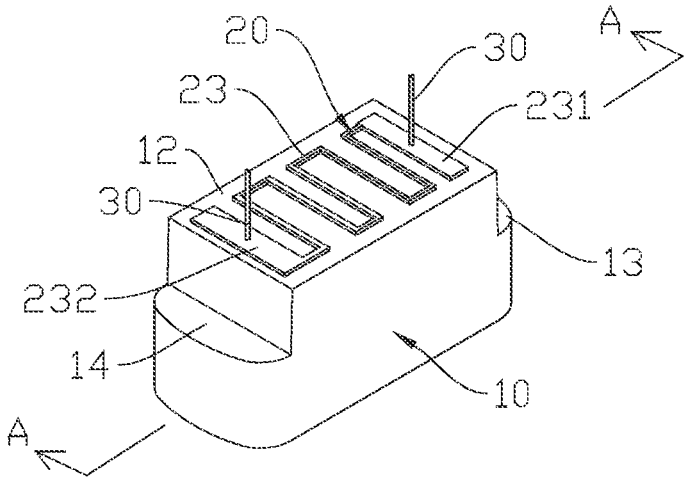
FIG. 2 is a perspective view, in a schematic form, showing the structure of the atomization assembly of FIG. 1 with a bottom facing upward.
Figure 3:
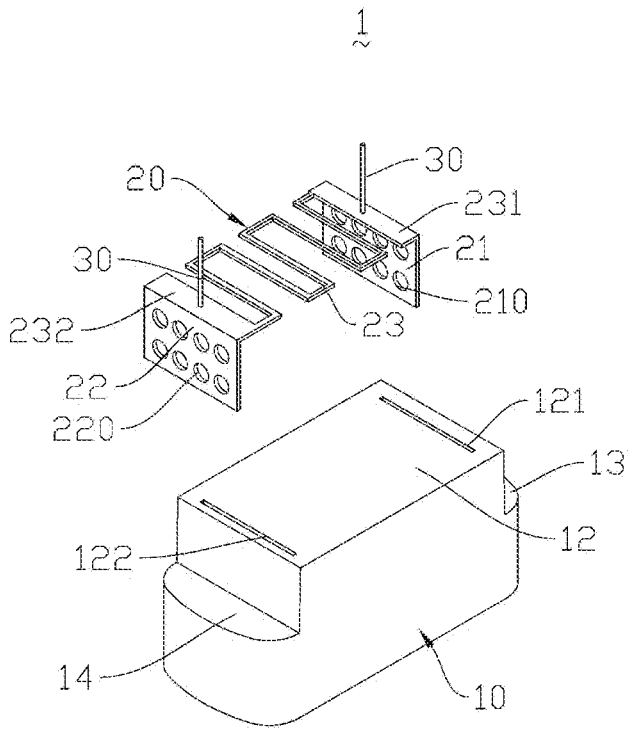
FIG. 3 is a perspective view, in an exploded form, showing the structure of the atomization assembly of FIG. 1.

FIGS. 1-3 show an atomization assembly 1 according to some embodiments of the present invention. The atomization assembly 1 is usable in an electronic atomization device, such as an electronic cigarette, for heating and atomizing a liquid medium, such as cigarette liquid. The atomization assembly 1 comprises a porous ceramic matrix 10, a heating body 20, and two electrode wires 30. The porous ceramic matrix 10 is provided for sucking in and conducting the liquid medium. The heating body 20 is mounted on the porous ceramic matrix 10 for heating and atomizing the liquid medium sucked in by the porous ceramic matrix 10. In some embodiments, the heating body 20 is integrally formed on the porous ceramic matrix 10 as one piece by means of sintering, in order to make connection between the two more secured and also to make the effect of atomization better. It is appreciated that in some embodiments, porous matrixes of other forms may be used to substitute the porous ceramic matrix. The two electrode wires 30 are respectively soldered to two ends of the heating body 20. In some embodiments, the electrode wires 30 may be omitted and two electrode contact points or portions of an alloy plate of the alloy heating body 20 may take the role of electrodes as a substitute for the above-described two electrode wires 30.

The porous ceramic matrix 10 is generally in the form of a rectangular cuboid and comprises a liquid suction face 11 located on a top thereof and an atomization face 12 located on a bottom thereof and opposite to the liquid suction face 11. The liquid suction face 11 is configured for contacting with the liquid medium in order to suck the liquid medium into the porous ceramic matrix 10. The atomization face 12 is configured for contacting with the heating body 20 to allow the liquid medium in the porous ceramic matrix 10 to be heated and atomized by the atomization face 12. It is appreciated that the arrangement of the liquid suction face 11 and the atomization face 12 is not limited to being opposite to each other, and in certain circumstances, it is possible to have two arranged adjacent to each other.

In some embodiments, the porous ceramic matrix 10 is made of a diatomite ceramic material. Diatomite ceramic undergoes a phase change from α-cristobalite to β-cristobalite within a predetermined range of temperature, such as in the range of 180° C. to 270° C. Such a phase change causes a certain amount of deformation of diatomite ceramic within a predetermined temperature range, meaning possession of a predetermined thermal expansion coefficient. Specifically, adjusting the content of diatomite in diatomite ceramic may control the thermal expansion coefficient thereof in a predetermined range, $18\text{-}45*10^{-6}/°$ C. Through adjusting the content of diatomite, the porous ceramic body 10 is made to have a thermal expansion coefficient thereof greater than or equal to a thermal expansion coefficient of the heating body 20, so as to prevent the alloy heating body 20 embedded in the porous ceramic body 10 from detaching from the porous ceramic body 10 due to warpage and deformation. The heating body 20 that detaches from the porous ceramic body 10 would suffer dry burning due to being not kept in contact with the cigarette liquid and such dry burning would lead to localized excessively high temperature in the heating body, fusing broken the beating body. On the other hand, the high temperature resulting from the dry burning may cause chemical reaction of the cigarette liquid that may generate harmful substance entraining air to get into human body to cause damage to human health. In some embodiments, the liquid suction face 11 is recessed in a direction toward the atomization face 12 in order to form a recessed cavity 110. The recessed cavity 110 may, on one hand, increase a surface area of the liquid suction face, and, on other hand, reduce a distance from the atomization face 12 to the liquid suction face 11 in order to increase a liquid transmission efficiency. In some embodiments, the atomization face 12 is planar and comprises a first embedding groove 121 and a second embedding groove 122 that are arranged parallel and spaced from each other to respectively receive a first fixing part 21 and a second fixing part 22 of the heating body 20 to fix therein. In some embodiments, the first embedding groove 121 and the second embedding groove 122 are parallel to each other in a lengthwise direction and are perpendicular to the atomization face 12 in a depth direction. It is appreciated that the first embedding groove 121 and the second embedding groove 122 are not limited to being in the atomization face.

In some embodiments, the porous ceramic matrix 10 may further comprise a first step 13 and a second step 14. The first step 13 and the second step 14 are respectively formed on two opposite sides of the porous ceramic matrix 20 to facilitate mounting of the porous ceramic matrix 10 in the electronic atomization device.

In some embodiments, the heating body 20 may comprise the first fixing part 21, the second fixing part 22, and a heating part 23. The first fixing part 21 and the second fixing part 22 are respectively connected to two ends of the heating part 23 and are extended in a direction toward one side of the heating part 23 for being respectively fixed in the first embedding groove 121 and the second embedding groove 121 of the atomization face 12. In some embodiments, the first fixing part 21, the second fixing part 22, and the heating part 23 are integrally formed, as one piece, of a metal plate through etching or stamping. The heating part 23 is configured for tightly contacting the atomization face 12 to have the liquid medium in the porous ceramic matrix 10 heated and thus atomized on the atomization face 12. The heating part 23 is bent, generally in a S-shaped form, and disposed on a plane to form a heating net, which, on one hand, enables uniformly heating of the heating part 23 to reduce non-uniformity of stress resulting from non-uniform heating of the heating body 20 and thus prolong the service life of the heating body 20, and, on other hand, enables uniform atomization of the liquid medium by the atomization face 12.

In some embodiments, the heating body 20 is made of a metal plate, such as a nickel-chromium alloy plate, an iron-chromium-aluminum alloy plate, and a stainless steel plate, and preferably, the heating body 20 is made of an iron-chromium-aluminum (FeCrAl) alloy material. The iron-chromium-aluminum (FeCrAl) alloy material may form a dense aluminum oxide film on a surface thereof at a high temperature in vacuum of 0.2-10 Pa, which prevents the iron-chromium-aluminum (FeCrAl) alloy material from being further oxidized. Specifically, the heating body 20 that is made of the iron-chromium-aluminum (FeCrAl) alloy material would have a surface thereof oxidized to form a dense aluminum oxide film during an operation of being integrally formed with the ceramic paste to form the atomization assembly 1. Preferably, the conditions of being oxidized to form the dense aluminum oxide film are: vacuum of 0.2-10 Pa and temperature of 1100° C.-1400° C. The dense aluminum oxide film may effectively prevent the heating body 20 from being oxidized through contacting the cigarette liquid medium, which may cause a chemical reaction for generating heavy metals so as to inhale, with atomized gas, into human lungs to influence the human health.

The heating body 20 preferably comprises an S-shaped net-like heating part 23, which is of a compact structure of which internal microscopic structure is uniformly distributed and electrical paths are excellently conducting so that the net-like heating part 23 has a uniform temperature distribution during heating, without causing excessive stress concentration. Further, when the net-like heating part 23 is made of metal, it shows excellent toughness and does not cause failure through defects and cracking, and has excellent stability of resistance and requires no inspection for outside flaws and dry burning performance, allowing for prolongation of service life of the heating body 20, operability under high power, and stable resistance facilitating design for circuit controlling temperature.

In some embodiments, as the heating body 20 is made of a metal plate by means of for example stamping, the fabrication cycle is short and the cost is low, allowing for realization of integral formation of the heating body 20 and the porous ceramic matrix 10 through one sintering operation, the operation being simple and cost being low.

In some embodiments, the heating part 23 is formed as a net-like configuration by means of etching processing, allowing the film width and film thickness to be slender and thin, and during the fabrication, the heating part 23 may be embedded in the porous ceramic matrix 10, meaning a plane defined by the heating part 23 of the heating body 20 is generally flush with the atomization face of the porous ceramic matrix 10 or slightly embedded in the atomization face, but does not affect atomization, so as to efficiently impregnate with a liquid medium such as the cigarette liquid, and achieve an effect of fast supply of the liquid in an application to electronic cigarettes, enhancing matchability with cigarette liquid, making flavor restoration high, realizing extended service life and high power.

In some embodiments, the metal heating body 20 is embedded in the porous ceramic matrix 10 and is excellently combined with the porous ceramic matrix 10. Further, the heating body 20 is arranged in a net-like form that shows elasticity, allowing for easy release of stress during thermal oscillation resulting from vaping and being not easy to detach.

Figure 4:
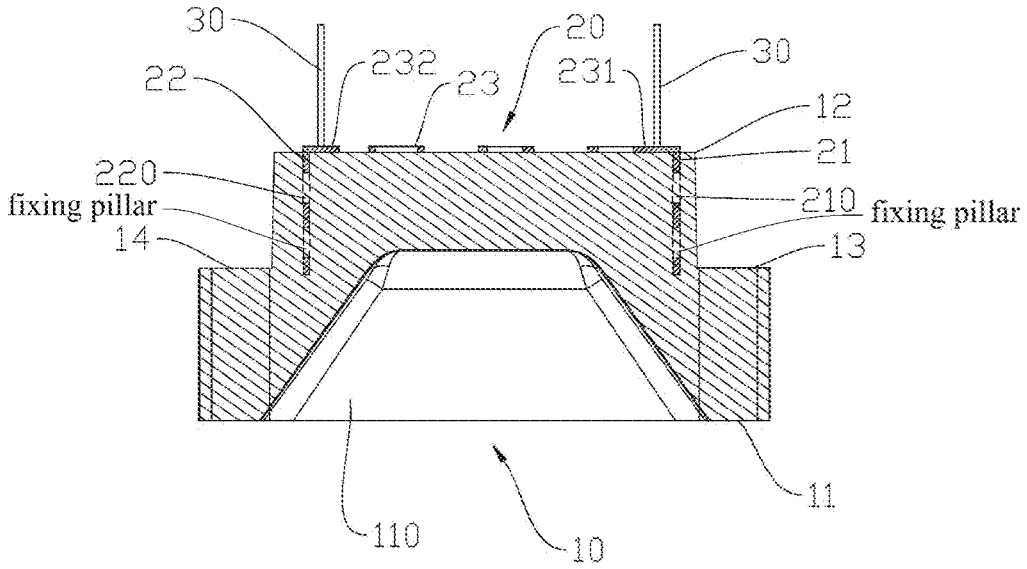
FIG. 4 is a cross-sectional view, in a schematic form, taken along line A-A of FIG. 1, showing the structure of the atomization assembly of FIG. 1.

In some embodiments, the heating body 20 is integrally formed with the porous ceramic matrix 10 as one piece, with the heating part 23 thereof tightly attached to the atomization face 12 (meaning being laid flat on the atomization face 12). In some embodiments, the first fixing part 21 and the second fixing part 22 are each in the form of a rectangular plate embedded in the porous ceramic matrix 10 and are respectively formed with a plurality of first fixing holes 210 and second fixing holes 220. Jointly referring to FIG. 4, the first fixing holes 210 and the second fixing holes 220 are configured to receive a material of the porous ceramic matrix 10 to extend therethrough during a forming process, in order to form fixing pillars (not labeled) located in the first embedding groove 121 and the second embedding groove 122 for locking the first fixing part 21 and the second fixing part 22 in the porous ceramic matrix 10, so as to make the heating body 20 and the porous ceramic matrix 10 more securely fixed after being integrally formed together. In some embodiments, the first fixing part 21 and the second fixing part 22 are each perpendicular to the plane on which the heating part 23 is located. In some embodiments, the heating part 23 may further comprise a first soldering part 231 and a second soldering part 232, the first soldering part 231 and the second soldering part 232 being respectively located on two ends of the heating part 23 to respectively connect with the first fixing part 21 and the second fixing part 22. In some embodiments, the first soldering part 231 and the second soldering part 232 are each of a rectangular shape having a width greater than a width of heating filaments in a middle of the heating part 23. The two electrode wires 30 are respectively soldered to the first soldering part 231 and the second soldering part 232 to respectively and electrically connect with positive and negative terminals of a power source.

In some embodiments, the heating body 20 may further comprise two first positioning holes formed in the first electrode and two second positioning holes formed in the second electrode. The first positioning holes and the second positioning holes are fit to first positioning pegs and second positioning pegs inside a forming cavity for positioning or fixing the heating body and to prevent the heating body from shifting due to impact by ceramic paste in the operation of being integrally formed with the porous ceramic blank.

A manufacturing process for the above-described atomization assembly 1 may include the following steps:

Step One: providing a porous ceramic paste and applying an etching operation to form the above-described heating body 20.

Step Two: respectively positioning a first fixing part 21 and a second fixing part 22 of the heating body 20 at predetermined locations in a forming cavity for a forming operation.

Step Three: injecting the ceramic paste into the forming cavity in which the heating body 20 is positioned and waiting for the ceramic paste to cure and shape, so that the cured and shaped ceramic paste forms a blank of a porous matrix 10. The first fixing part 21 and the second fixing part 22 of the heating body 20 are each embedded in the blank of the porous matrix 10, and a material of the porous matrix extends through first fixing holes 210 and second fixing holes 220.

Step Four: removing the blank that carries the heating body 20 out of the forming cavity to subject to high temperature sintering, such that the blank is sintered to form the porous ceramic matrix 10, and the heating body 20 is integrally combined in the porous ceramic matrix 10 to form the above-described atomization assembly 1.

In some embodiments, a material for the heating body 20 provided in Step One includes a metallic material that features fast temperature rise and uniform heat generation, such as one of the following materials, a nickel-chromium alloy, an iron-chromium-aluminum alloy, stainless steel, pure nickel, titanium, and nickel iron. In some embodiments, the material of the heating body 20 in Step One is an iron-chromium-aluminum (FeCrAl) alloy material.

In some embodiments, in Step Two, the positioning of the heating body is achieved by having two first positioning holes and two second positioning holes fit to positioning pillars inside the forming cavity.

In some embodiments, the heating body 20 includes a one-piece metal part, which is manufactured as being integrally formed by adopting one or more of a laser cutting technique, a stamping technique, and an etching technique, or alternatively, the heating body 20 may have parts that are made separately and is formed through bonding together by applying welding or other bonding techniques.

In some embodiments, in Step Two, the heating body 20 that features fast temperature rise and uniform heat generation is positioned in the forming cavity and the ceramic paste that is in a melt form and is uniformly stirred is poured into the forming cavity in which the heating body 20 is positioned at a predetermined location.

In some embodiments, before high temperature sintering of Step Four, an additional step is provided: removing out the cured and shaped ceramic paste to obtain a ceramic heating body blank, and subjecting the ceramic heating body blank to glue-removing sintering in an oxygen-containing environment so as to have vaporize a bonding agent in a high temperature to thereby obtain a glue-removed blank. Preferably, a temperature for the above sintering is arranged at 200° C.-800° C.

In some embodiments, the high temperature sintering of Step Four is performed with vacuum high temperature sintering, and preferable vacuum is 0.2-10 Pa. High temperature sintering performed in such a vacuum (0.2-10 Pa) environment allows the alloy material of the heating body 20 that is formed on the porous ceramic matrix 10 to form a dense oxide film. Particularly, for the heating body 20 that is made of a FeCrAl alloy material, the densification effect is even better, and the dense oxide film can effectively prevent the heating body 20 from chemically reacting with a liquid, such as the cigarette liquid, to cause precipitation of heavy metals to entrain with atomization gas into human lungs to affect human health.

In some embodiments, the temperature for the high temperature sintering of Step Four is 1100° C.-1400° C.

Figure 5:
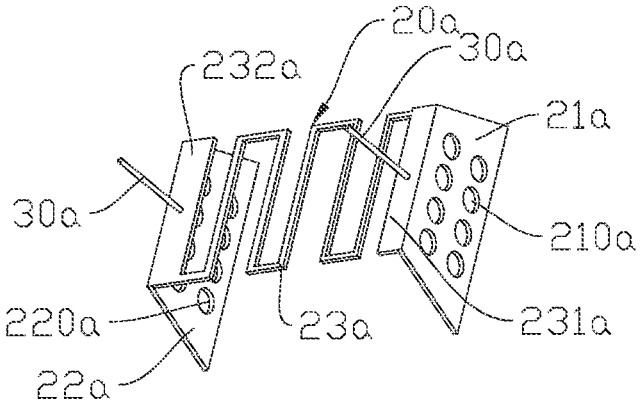
FIG. 5 is a perspective view, in a schematic form, showing a structure of a heating body of an atomization assembly according to some other embodiments of the present invention.

FIG. 5 shows a heating body 20*a* of an atomization assembly according to some other embodiments of the present invention. In some embodiments, the heating body 20*a* may comprise a first fixing part 21*a*, a second fixing part 22*a*, and a heating part 23*a*. The first fixing part 21*a* and the second fixing part 22*a* are respectively connected to two ends of the heating part 23*a* and are extended in a direction toward one side of the heating part 23*a*.

The heating part 23*a* is bent, generally in an S-shaped form, and is disposed, in a tight engagement manner, on the atomization face 12, but is not securely fixed thereto. In this way, the heating part 23*a* is provided with a space for movement for thermal expansion and contraction, in order to reduce the tensile stress thereof to thereby prolong the service life of the heating body 20*a*. In some embodiments, the first fixing part 21*a* and the second fixing part 22*a* are each in the form of a rectangular plate, and are respectively formed with a plurality of first fixing holes 210*a* and second fixing holes 220*a*. Jointly referring to FIG. 4, the first fixing holes 210*a* and the first fixing holes 220*a* are configured to receive a material of the porous ceramic matrix 10 to extend therethrough during a forming process, in order to make the heating body 20*a* and the porous ceramic matrix 10 more securely fixed after being integrally formed together. In some embodiments, the first fixing part 21*a* and the second fixing part 22*a* are each perpendicular to the plane on which the heating part 23*a* is located.

In some embodiments, the heating part 23*a* may further comprises a first soldering part 231*a* and a second soldering part 232*a*. The first soldering part 231*a* is connected and fixed between the first fixing part 21*a* and the heating part 23*a*, and the second soldering part 232*a* is connected and fixed between the second fixing part 22*a* and the heating part 23*a*, so that the heating part 23*a* is arranged to receive each of the first fixing part 21*a* and the second fixing part 22*a* to connect thereto and to generate heat jointly with the heating part 23*a*, to allow the liquid medium in the porous ceramic matrix 10 to be heated and atomized on the atomization face 12. In some embodiments, the first soldering part 231*a* and the second soldering part 232*a* are each of a rectangular shape having a surface area generally corresponding to that of the fixing parts, for having the heating body securely fixed thereto without easily breaking.

In some embodiments, the heating body 20*a* may further comprise two electrode wires 30*a*. The two electrode wires 30*a* are respectively mounted on the first soldering part 231*a* and the second soldering part 231*a* and are respectively perpendicular to the first soldering part 231*a* and the second soldering part 232*a* for electrical connection with positive and negative terminals of a power source.

In some embodiments, the first fixing part 21*a* and the second fixing part 22*a* of the heating body 20*a* are each of a shape of trapezoid, wherein the trapezoid short-base portions of the two are located close to the heating part 23*a*, while the trapezoid long-base portions are located distant from the heating part 23*a*, namely the first fixing part 21*a* and the second fixing part 22*a* each comprise a large-size portion that is distant from the heating part 23*a* and a small-size portion that is close to the heating part 23*a*. Such a structural arrangement allows the first fixing part 21*a* and the second fixing part 22*a* not to readily detach when integrally embedded in the porous matrix.

Figure 6:
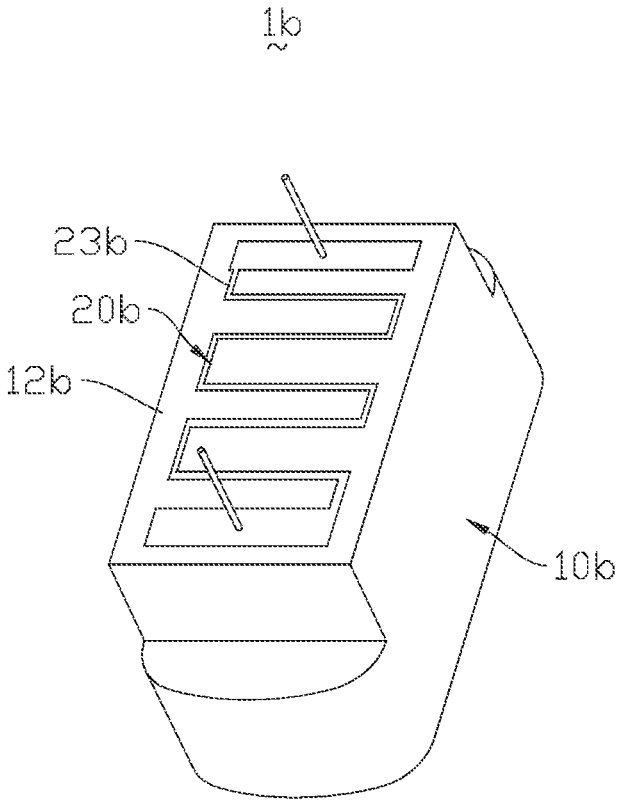
FIG. 6 is a perspective view, in a schematic form, showing a structure of an atomization assembly according to some additional embodiments of the present invention, with a bottom facing upward.
Figure 7:
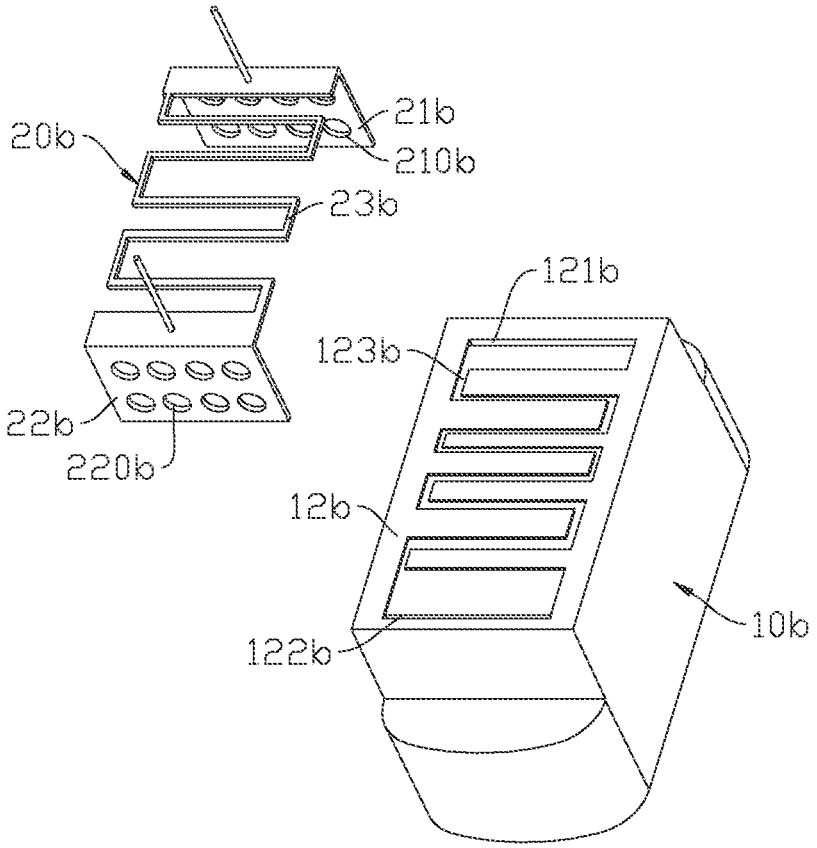
FIG. 7 is a perspective view, in an exploded form, showing the structure of the atomization assembly of FIG. 6.

FIGS. 6 and 7 show an atomization assembly 1*b* according to some additional embodiments of the present invention. The electronic atomization device 1*b* may also comprise a porous ceramic matrix 10*b* and a heating body 20*b*. The heating body 20*b* is integrally formed on the porous ceramic matrix 10*b* by means of sintering. The heating body 20*b* may comprise a first fixing part 21*b*, a second fixing part 22*b*, and a heating part 23*b*. The first fixing part 21*b* and the second fixing part 22*b* are respectively connected to two ends of the heating part 23*b* and are extended in a direction toward one side of the heating part 23*b*. The porous ceramic matrix 10*b* comprises an atomization face 12*b*, and a first embedding groove 121*b*, a second embedding groove 122*b*, and a third embedding groove 123*b* are formed in the atomization face 12*b*. The first fixing part 21*b*, the second fixing part 22*b*, and the heating part 23*b* are respectively fit into and embedded in the first embedding groove 121*b*, the second embedding groove 122*b*, and the third embedding groove 123*b*. As shown in the drawings, the third embedding groove 123*b* has a depth that corresponds to a thickness of the heating part 23*b*, so that when the heating part 23*b* is fit therein, an outside surface of the heating part 23*b* is flush with the atomization face 12*b*. It is appreciated that in some embodiments, it is possible to have the depth of the third embedding groove 123*b* less than or greater than the thickness of the heating part 23*b* to suit for different needs. In some embodiments, the first fixing part 21*b* and the second fixing part 22*b* are respectively formed with a plurality of the first fixing holes 210*b* and second fixing holes 220*b*.

Figure 8:
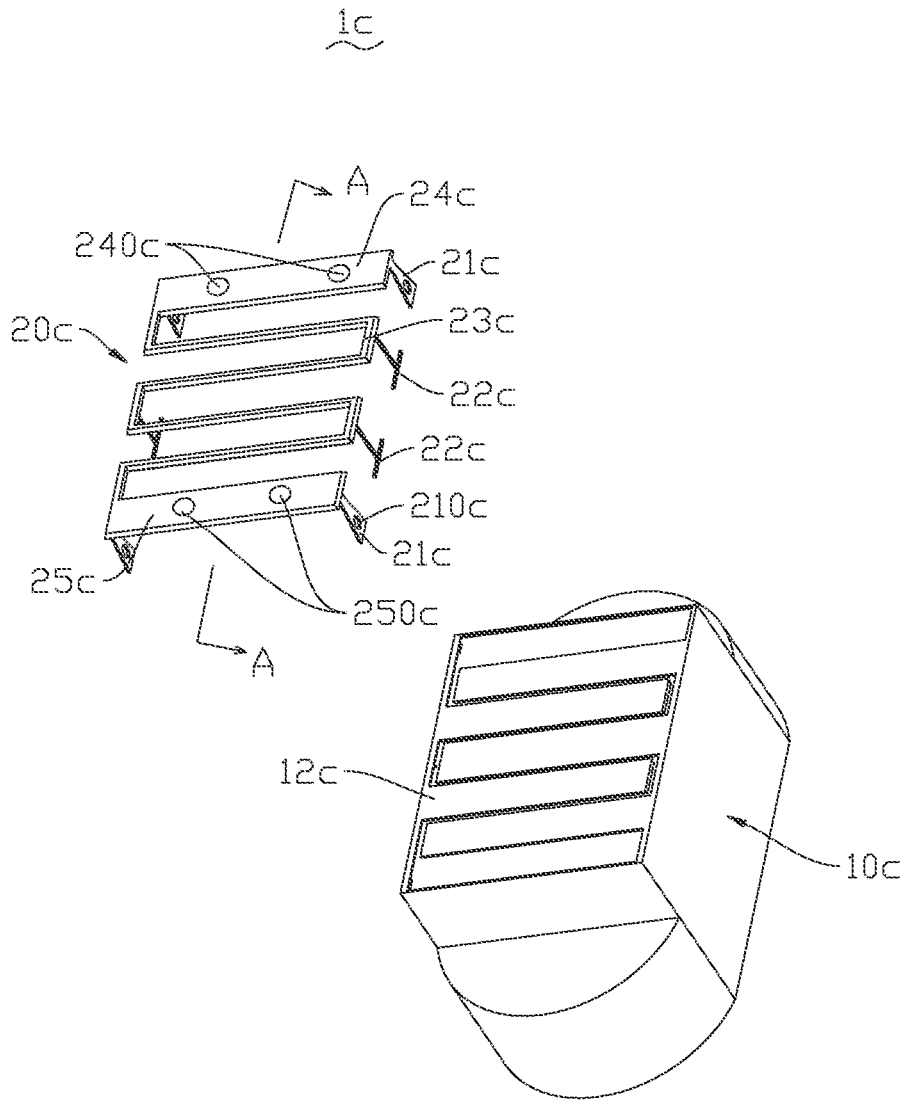
FIG. 8 is a perspective view, in a schematic form, showing a structure of a heating body of an atomization assembly according to some further additional embodiments of the present invention.

FIG. 8 shows a heating body 20*c* of an atomization assembly 1*c* according to some further additional embodiments of the present invention. In some embodiments, the heating body 20*c* comprises a heating part 23*c* and a first electrode part 24*c* and a second electrode part 25*c* connected to two ends of the heating part. The heating part 23*c* is bent, generally in an S-shaped form, and is disposed, in a tight engagement manner, on the atomization face 12, but is not securely fixed thereto. In this way, the heating part 23*c* is provided with a space for movement for thermal expansion and contraction, in order to reduce the tensile stress thereof to thereby prolong the service life of the heating body 20*c*. The first electrode part 24*c* and the second electrode part 25*c* are respectively connected to two ends of the heating part 23*c*, that is connecting to two free ends of the S-shaped heating part 23*c*.

In some embodiments, the heating part connected between the first electrode part 24*c* and the second electrode part 25*c* is such that line width is gradually increased from the connection thereof with the first electrode and the second electrode toward a middle of the heating part. This could balance temperature of the entire heating part 20*c*, ensuring temperature distribution uniformity of the entirety of the heating part.

Figure 9:
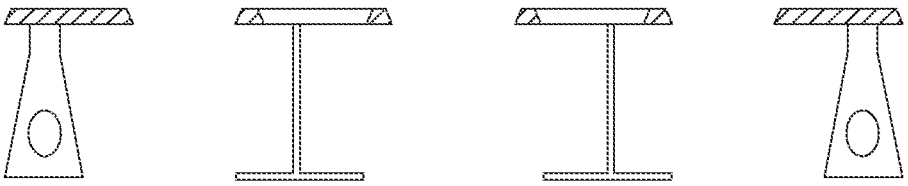
FIG. 9 is a cross-sectional view, in a schematic form, showing the structure of the heating body of the atomization assembly shown in FIG. 8.

In some embodiments, as shown in FIG. 9, heating wires of the heating part 23*c* have a cross-section exhibiting a shape of trapezoid, meaning a surface of the heating part 23*c* at the end that is in contact with or embedded in the atomization face 12*c* has a larger surface area (being on the long base of the trapezoidal cross-section), while a surface of the heating part that is opposite to the atomization face 12*c* has a smaller surface area (being on the short base of the trapezoidal cross-section). Such a trapezoidal arrangement helps liquid to climb upward on one hand, and also helps improve embeddability of the heating part 20*c* in the porous ceramic matrix 10*c* to prevent warpage of the heating part. The cross-sectional shape of the heating wires of the heating part 23*c* is not limited to such a trapezoidal shape and may be a semi-cylindrical shape or other shapes based on the requirement that the surface areas on the top and bottom surfaces are different.

In some embodiments, the first electrode part 24*c* and the second electrode part 25*c* are each in the form of a rectangular plate, and are respectively formed with a plurality of first positioning holes 240*c* and second positioning holes 250*c*, which are fit to corresponding positioning pegs inside a forming cavity in a one-piece forming process, in order to prevent the heating body from shifting due to impact by ceramic paste.

In some embodiments, the heating body 20*c* may further comprise a plurality of first fixing part 21*c* and a plurality of second fixing part 22*c*. The plurality of first fixing part 21*c* are respectively arranged on two opposite short-edged sides of the first electrode part 24*c* and two opposite short-edged sides of the second electrode part 25*c* and are extended in a direction toward one side of the heating part 23*c* for being integrally formed with the porous ceramic body blank to fix the heating body 20*c*. In some embodiments, the plurality of first fixing part 21*c* and the plurality of second fixing part 22*c* may be respectively formed on ends of long-edge sides of the first electrode part 24*c* and the second electrode part 25*c* that are distant from the heating part 23*c*. The plurality of second fixing part 22*c* are respectively connected to side edges of the heating part 23*c* and extended in a direction toward one side of the heating part 23*c* for being integrally formed with the porous ceramic body blank to fix the heating body 20*c*. In some embodiments, as shown in FIG. 8, the second fixing parts 22*c* are each of a T-shape, and one end connected to the heating part 23*c* is a lower end of the T-shape for facilitating fixing of the heating body 20*c* on one hand and for reducing loss of heat on other hand.

In some embodiments, the first fixing parts 21*c* may comprises a plurality of first fixing holes 210*c* formed therein. The first fixing holes 210*c* are arranged to receive a material of the porous ceramic matrix 10 to extend therethrough in a forming process, in order to make the heating body 20*c* and the porous ceramic matrix 10*c* more securely fixed after being integrally formed together. In some embodiments, the first fixing parts 21*c* are of a shape of trapezoid, and a short-base portion of the trapezoid is located close to the heating part 23$c$, while a long-base portion of the trapezoid is located distant from the heating part 23$c$, namely the first fixing parts 21$c$ each comprise a large-size portion that is distant from the heating part 23$c$ and a small-size portion that is close to the heating part 23$c$. Such a structural arrangement allows the first fixing parts 21$c$ not to readily detach when integrally embedded in the porous matrix.

In some embodiments, the first fixing parts 21$c$ and the second fixing parts 22$c$ are each perpendicular to a plane on which the heating part 23$c$ in located.

For some embodiments, the above description provides only some specific examples of the present invention. However, the present invention is not limited to the description, and variations that can be contemplated by those skilled in the field fall in the protection scope of the present invention.

What is claimed is:

1. An atomization assembly, comprising a porous matrix and a heating body, the porous matrix comprising an atomization face, wherein the heating body comprises a heating part and at least one fixing part connected to the heating part, the at least one fixing part being embedded in the porous matrix so as to have the heating body mounted on the porous matrix, the heating part being arranged to contact the atomization face;

the at least one fixing part is in the form of a plate and formed with at least one fixing hole, and during a process of integrally forming, the porous matrix penetrates into the at least one fixing hole to form at least one fixing pillar that corresponds to the at least one fixing hole; and/or, the at least one fixing part comprises a large-size portion distant from the heating part and a small-size portion adjacent to the heating part.

2. The atomization assembly according to claim 1, wherein the heating body is integrally formed on the porous matrix by means of sintering, and the porous matrix is a porous ceramic matrix.

3. The atomization assembly according to claim 2, wherein the porous ceramic matrix is made of a diatomite ceramic material.

4. The atomization assembly according to claim 1, wherein the at least one fixing part is of a shape of trapezoid, wherein a short-base portion of the trapezoid of the at least one fixing part is located adjacent to the heating part, and a long-base portion of the trapezoid is located distant from the heating part.

5. The atomization assembly according to claim 1, further comprising at least one second fixing part connected to the heating part, the at least one second fixing part being of a T-shape, the heating part being connected to a small end of the T-shape.

6. The atomization assembly according to claim 1, wherein the heating body is made of an iron-chromium-aluminum (FeCrAl) alloy material.

7. The atomization assembly according to claim 6, wherein the heating part comprises a heating net which comprises a heating wire, the heating wire having a cross-section that is of a shape of trapezoid, a surface on which a long base of the trapezoid is located being embedded in the atomization face, a short base of the trapezoid being slightly higher than the atomization face or being flush with the atomization face.

8. The atomization assembly according to claim 1, wherein the heating body further comprises a first electrode part and a second electrode part connected to two ends of the heating part, the first electrode part and the second electrode part being in the form of a rectangular plate; the at least one fixing part comprises a first fixing part and a second fixing part that are spaced from each other, the first fixing part and the second fixing part being respectively connected with the first electrode part and the second electrode part.

9. The atomization assembly according to claim 8, wherein the heating part comprises a first soldering part and a second soldering part located on two ends thereof; the atomization assembly further comprises two electrode wires, the two electrode wires being respectively and electrically connected with the first soldering part and the second soldering part.

10. The atomization assembly according to claim 1, wherein the heating part is embedded in or laid flat on the atomization face; the porous matrix comprises a liquid suction face opposite to the atomization face, the liquid suction face being recessed in a direction toward the atomization face to form a recessed cavity.

11. A manufacturing method for the atomization assembly according to claim 1, comprising the following steps:

Step One: providing a porous ceramic paste and the heating body:

Step Two: forming a porous ceramic blank that is combined with the heating body, wherein the porous ceramic blank comprises a surface that corresponds to the atomization face after formation; the fixing parts of the heating body are embedded in the porous ceramic blank, and the heating part contacts the contacts the surface that corresponds to the atomization face after formation;

Step Three: subjecting the porous ceramic blank that carries the heating body to high temperature sintering under conditions of vacuum being 0.2-10 Pa and a temperature being 1100° C.-1400° C.

12. The manufacturing method for the atomization assembly according to claim 11, wherein a step is added between Step Three and Step Four and comprises: subjecting the porous ceramic blank to glue-removing sintering in an oxygen-containing environment at a temperature of 200° C.-800° C. to obtain a glue-removed porous ceramic blank.

13. An electronic atomization device, comprising an atomization assembly, the atomization assembly comprising a porous matrix and a heating body, and the porous matrix comprising an atomization face; wherein, the heating body comprises a heating part and at least one fixing part connected to the heating part, the at least one fixing part being embedded in the porous matrix so as to have the heating body mounted on the porous matrix, the heating part being arranged to contact the atomization face;

the at least one fixing part is in the form of a plate and formed with at least one fixing hole, and during a process of integrally forming, the porous matrix penetrates into the at least one fixing hole to form at least one fixing pillar that corresponds to the at least one fixing hole; and/or, the at least one fixing part comprises a large-size portion distant from the heating part and a small-size portion adjacent to the heating part.

14. The electronic atomization device according to claim 13, wherein the heating body is integrally formed on the porous matrix by means of sintering, and the porous matrix is a porous ceramic matrix.

15. The electronic atomization device according to claim 13, wherein the heating body further comprises a first electrode part and a second electrode part connected to two ends of the heating part, the first electrode part and the second electrode part being in the form of a rectangular plate; the at least one fixing part comprises a first fixing part and a second fixing part that are spaced from each other, the first fixing part and the second fixing part being respectively connected with the first electrode part and the second electrode part.

16. The electronic atomization device according to claim 13, wherein the heating part is embedded in or laid flat on the atomization face; the porous matrix comprises a liquid suction face opposite to the atomization face, the liquid suction face being recessed in a direction toward the atomization face to form a recessed cavity.

* * * * *